United States Patent [19]

Klingelhöfer et al.

[11] 4,183,193

[45] Jan. 15, 1980

[54] SYSTEM FOR PACKAGING A SUCCESSION OF OBJECTS IN A FOIL

[75] Inventors: Hannsgeorg Klingelhöfer; Fridrich Mann, both of Nürtingen, Fed. Rep. of Germany

[73] Assignee: Firma Bielomatik Leuze & Co., Neuffen, Fed. Rep. of Germany

[21] Appl. No.: 877,296

[22] Filed: Feb. 13, 1978

[30] Foreign Application Priority Data

Feb. 17, 1977 [DE] Fed. Rep. of Germany ..... 2706676

[51] Int. Cl.[2] ..... B65B 9/06

[52] U.S. Cl. ..... 53/450

[58] Field of Search ..... 53/228, 76, 450, 463, 53/466, 479, 550, 551, 553

[56] References Cited

U.S. PATENT DOCUMENTS

| | | | |
|---|---|---|---|
| 2,213,602 | 9/1940 | Yates | 53/553 |
| 2,555,758 | 6/1951 | Noble et al. | 53/550 |
| 2,600,216 | 6/1952 | Denison | 53/479 |
| 3,283,470 | 11/1966 | Delze | 53/463 X |
| 3,473,288 | 10/1969 | Nakamura et al. | 53/550 X |
| 3,611,674 | 10/1971 | Glickston | 53/550 X |
| 3,653,177 | 4/1972 | Adams et al. | 53/550 |

FOREIGN PATENT DOCUMENTS

| | | | |
|---|---|---|---|
| 338600 | 6/1918 | Fed. Rep. of Germany | 53/550 |

*Primary Examiner*—John Sipos
*Attorney, Agent, or Firm*—Karl F. Ross

[57] ABSTRACT

A packaging system has a guide at a sealing station which forms the leading end of an elongated wrapping foil into a tube having a closed downstream end. A conveyor feeds a succession of objects spaced apart in a transport direction by gaps into the tube at this station. A pair of grippers can close on the leading edge of the object to be wrapped in the tube and pull it through the sealing station so as to position its rear end immediately downstream of a pair of vertically displaceable welding tools that are closed on the tube in back of the object to weld together the sides of the tube and form a new closed end on the tube.

9 Claims, 5 Drawing Figures

SYSTEM FOR PACKAGING A SUCCESSION OF OBJECTS IN A FOIL

FIELD OF THE INVENTION

The present invention relates to a packaging method and apparatus. More particularly this invention concerns a system for automatically wrapping and sealing a succession of discrete objects in a sealable wrapping web such as a synthetic-resin sheet or foil.

BACKGROUND OF THE INVENTION

It is known to package objects in a thermoplastic and heat-shrinkable synthetic-resin sheet or foil in an automatic machine to which is delivered a succession of objects to be packaged as well as a continuous supply of the wrapping web and which produces at its output a succession of discrete individually wrapped packages. The wrapping web is typically fed as a single sheet or foil from a supply roll to the machine. In the machine its two longitudinal edges are folded over and welded together automatically to form a tube into which the succession of objects is fed. Transverse sealing bars are provided which form transversely extending seals between the two sides of the tube in front of and in back of each object to be wrapped, and a blade normally connected to the welding tools serves to sever off the packaged and sealed-in object.

In order to form these transverse seams in a continuously operating process it is necessary either to stop the advance of the object as the transverse seams are formed, or to move the welding tools along with the object for the welding operation. In this latter arrangement it is necessary to feed the objects in, regardless of their lengths, at predetermined intervals so that the synchronizing equipment for displacement of the welding tools along with the moving objects can be made as simple as possible. Even in such an arrangement, however, the system remains rather complex and trouble-prone, and when relatively short objects are being packaged considerable quantities of the wrapping web are wasted. Furthermore in such arrangements the foil normally used as a wrapping web typically wrinkles up on the objects and presents an unattractive appearance.

Other systems allow more adjustment for package length, but in each case the welding time therefore becomes a function of conveying speed and package length. Thus some of the seams will be inadequately strong because of a too short welding time and others might be melted completely through due to a too long welding time.

U.S. Pat. No. 3,473,288 has suggested a system wherein the objects, once inside the tube, are advanced between upper and lower belts which vertically pinch the entire package and tube together. Such an arrangement has the disadvantage, however, that an exact positioning of the objects during the welding operation is still not ensured. Thus occasionally the welding tools will close down on the object itself, or at a relatively long distance from the object making the package loose and unattractive. This is normally compensated for by providing a relatively large gap between packages so that even though some of the wrapping web is wasted the seam is sure to fall in an empty area between adjacent objects.

Other solutions have been suggested such as in German Pat. No. 338,600 and in German Patent Publication No. 1,800,988. None of these arrangements is capable of adjusting to objects of different lengths and heights, so as to form a succession of snug and neat packages without substantial waste of the wrapping web.

OBJECTS OF THE INVENTION

It is therefore an object of the present invention to provide an improved packaging method and apparatus.

Another object is to provide a packaging system which can be set up for objects of varied length, but which will produce in every case snug and neat packages without waste of the wrapping web.

Yet another object is to provide such a packaging system which operates in a relatively simple manner and wherein the apparatus will have a long service life.

SUMMARY OF THE INVENTION

These objects are attained according to the present invention in a packaging method wherein a succession of objects is advanced one by one to a sealing station having a fixed sealing location in a transport direction with the leading end of each object spaced by a predetermined gap behind the trailing end of the preceding object. A web is fed to the station in the direction of transport and formed into a tube which is wrapped around the object or into which the objects are advanced. This web is gripped against opposite sides of each object after wrapping of the web around the objects or feeding of the objects into the web, and thereafter the wrapped object with the web gripped to it is displaced through a predetermined distance to align the respective gap trailing it with the sealing location. The two sides of the tube formed by the web are pinched and welded together at the gap in the location and the wrapped object downstream of the location is severed from the web. Thereafter the severed-off and wrapped object is advanced from the sealing station. Most of the above-given steps are then repeated successively with each of the succeeding objects.

The apparatus according to this invention therefore has a pair of welding tools at the sealing station which are oppositely displaceable transversely of the transport direction and which are closely juxtaposable at the welding location. These welding tools are not displaceable in the conveyor direction along with the objects, but act on the objects only when they are stationary. The objects are held during welding by a pair of grippers which are closable and openable transversely of the transport direction and are displaceable jointly between a grabbing position upstream of the welding location and a releasing position downstream of the location. Thus the grippers can be closed when in the grabbing position on an object in the station in the tube formed by the wrapping web and can thereafter be displaced with the gripped object into the releasing position where the grippers are opened. Therefore the object in the web is gripped and displaced in the transport direction by these grippers and the web is pulled in this direction by the grippers. When the grippers are in the releasing position, but before they are opened, the welding tools are closed on the tube immediately behind the object so as to accurately form a rear heat seal on each package and to form a front heat seal for the succeeding package. At the same time that the transverse weld is formed the furthest downstream object is severed off the web.

Thus with the system according to the present invention once held by the gripper any relative displacement of the tube formed by the wrapping web and the object being wrapped is impossible. Furthermore an exact and accurate positioning of the object in the wrapping web is possible in every case. The welding time can furthermore be set for the optimum value for the particular wrapping web employed, normally depending on the type of thermoplastic material being used and its thickness. Finally this arrangement allows the foil to be used without waste, as the welding tool typically forms a pair of parallel welded seams between which the web is severed, so that there is absolutely no waste of the wrapping web with the system according to this invention. If the thus formed package is subjected to a subsequent shrinking, it is therefore possible to conform the wrapping web exactly to the object wrapped.

According to another feature of this invention it is possible to displace the wrapped object in the grippers first downstream through the above-mentioned predetermined distance, then back upstream through a small step equal to a fraction to the length of the gap between two adjacent objects immediately before the welding operation. Similarly immediately before the welding operation the tube can be displaced slightly downstream so as to form slack in the wrapping web between two adjacent objects. When the objects being wrapped are particularly tall this variation of the method allows the heat seal to be formed between adjacent objects without unduly stretching the foil to pinch the tube together between adjacent objects.

According to further features of this invention the grippers are constituted by a lower gripper having an upper gripper surface substantially at the level of the support surface defined by input and output conveyors of the machine, and an upper gripper having a lower gripper surface spaced a predetermined height above the upper surface of the lower gripper. The upper gripper at least is made vertically displaceable so that its rest position, that is its position where it is somewhat further from the lower gripper than in the gripping position when it is displaced toward the lower gripper, can be steplessly adjusted for packages of any height. Such adjustment allows the displacement necessary to close the grippers on an object to be reduced to a minimum so that the objects will be very firmly gripped and at the same time little time will be needed to close the gripper on the object.

According to a particular feature of this invention the input conveyor at least is provided with a plurality of pushers which engage the rear or trailing edges of the objects as it pushes them toward the sealing station where the objects are pushed into the closed end of the tube formed by the wrapping web. The operation of the grippers as well as the welding tools is synchronized to the positions of these pushers, so that the device hardly need be readjusted for objects of different lengths within a relatively wide range, as the position of the front or leading end of an object in the sealing station is irrelevant so long as the leading end of the object projects far enough for the grippers to hold it. The machine merely needs readjustment when the objects height changes. In particular since the objects are pushed into the tube formed by the foil, a particular complex feeding or advancing arrangement for the foil is also completely unnecessary.

SPECIFIC DESCRIPTION

Figure 1:
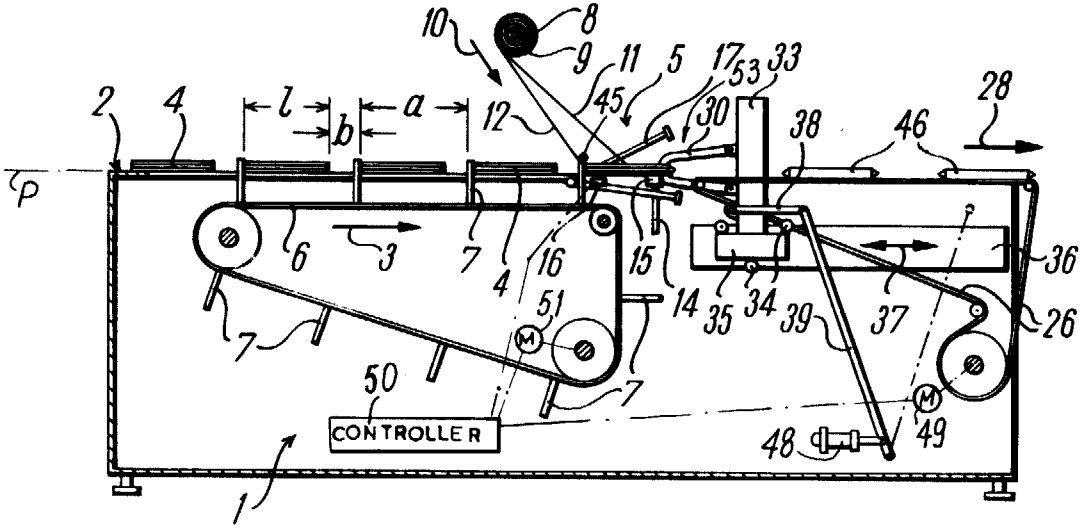
FIG. 1 is a vertical section through an apparatus according to the instant invention.
Figure 2:
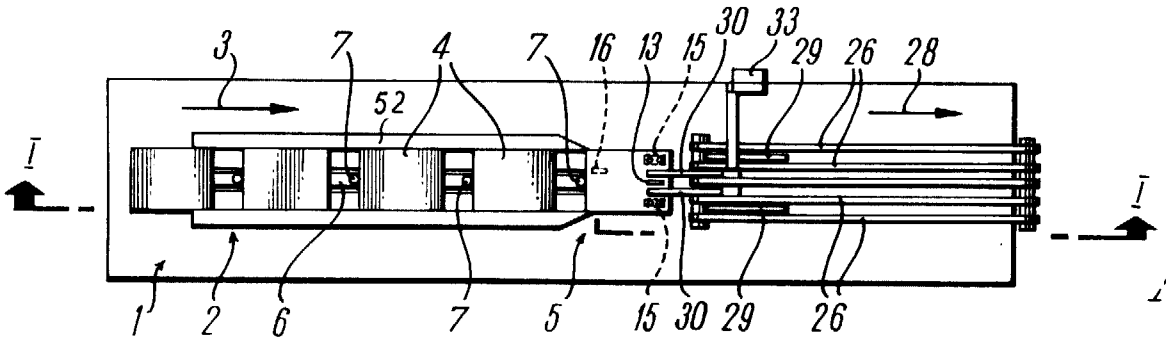
FIG. 2 is a top view of the apparatus of FIG. 1, with line I—I showing the section plane for FIG. 1.

As shown in FIGS. 1 and 2 the packaging apparatus according to this invention has a housing 1 with a planar upper surface 2 defining a horizontal plane P along which objects 4, here stacks of like articles, are advanced in a direction 3 to a central wrapping and sealing station 5.

Upstream of the station 5 the objects 4 are displaced by means of a conveyor belt 6 driven by a motor 51 via a controller 50 and having a succession of upstanding pusher elements 7. These latter elements 7 engage through a slot in the upper wall 2 of the housing and are displaceably fixed on the belt 6 so that the spacing a between them can be varied in accordance with the length l of the workpiece 4 and the length b of the gap between them. The transport path upstream of the station 5 is defined between a pair of guides 52 so that only one pusher 7 is needed for each workpiece 4.

Figure 3:
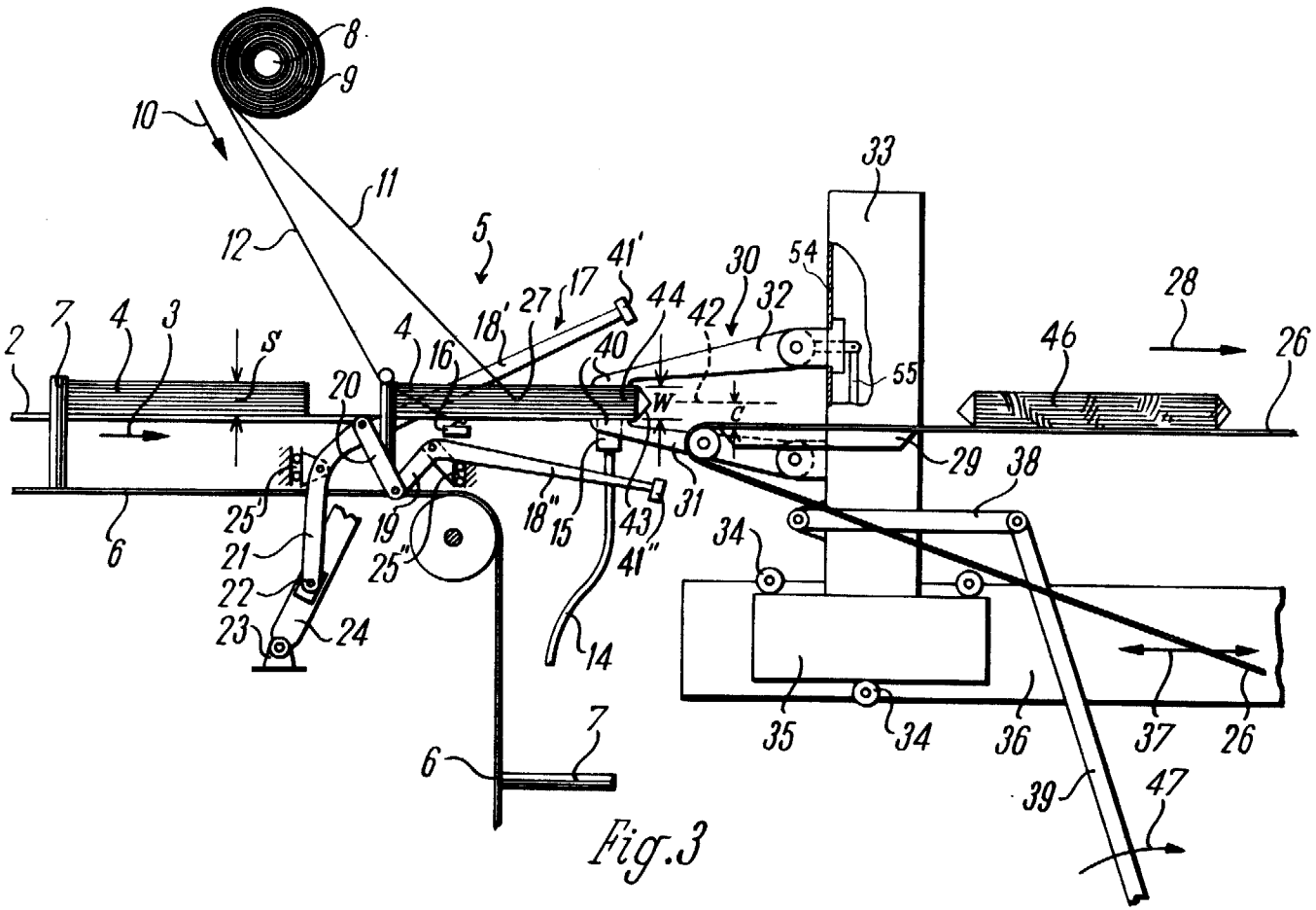
FIGS. 3, 4, and 5 are large-scale and partly schematic side views showing the operation of the machine according to this invention at successive stages of packaging.

Above the housing 1 there is provided a supply 8 of a polyethylene foil 9 that is pulled in a direction 10 toward the station 5 in a manner to be described below. Fixed immediately upstream in the direction 3 of the station 5 is a pair of L-shaped guide arms 45 over which the foil 9 is passed so that its central longitudinally extending section 11 remains above its two edge regions 12 which are bent over and under each other so as to form a tube in the manner suggested by the above-described patent publications whose entire disclosures are herewith incorporated by reference. A longitudinal heat sealer 13 is provided at this station 5 in the middle between a pair of suction holders 15 connected via suction lines 14 to a nonillustrated vacuum source. Thus the tube formed by the foil 9 is held open and the portion where its two edges are overlapped is welded together by means of the hot welding tool 13. The spreading arms 45 are so positioned that, as will be described below, the objects 4 that are moved along in the direction 3 are pushed into the end of the tube formed by the foil 9 so as to form an intermediate partly completed package 27 (FIG. 3).

A microswitch 16 detects the presence of one of the objects 4 in the station 5 and is connected to the controller 50 to prevent operation of the downstream mechanism unless an object 4 is in the station 5, and indeed in the tube formed by the foil 9 to form an intermediate workpiece 27.

A transverse welding device 17 for forming a transverse seam between adjacent objects 4 is constituted by an upper arm 18' and a lower arm 18" carrying respective transversely extending welding bars 41' and 41". The welding arms 18" is formed as a two-arm lever having a second arm 19 connected via link 20 to the arm 18' so that the two arms 18' and 18" will inherently pivot in opposite directions and will meet at a plane 42 (FIG. 3) at a welding location 53 in the station 5. The upper arm 18' is also formed as a two-arm lever having a rear arm 21 pivoted at 22 on a lever 24 pivoted in turn on the machine frame at 23 and connected via a nonillustrated linkage to an operating cylinder 48 itself operated by the controller 50. In addition the arms 18' and 18" are carried on respective pivots 25' and 25" which are vertically adjustable so as to vary the position of the plane 42 at which they meet.

Downstream of the station 5 there is provided an output transport belt 26 having an upper surface lying on the plane P and having an upper reach normally moving in a direction 28 parallel to the transport direction 3. A pair of vertically displaceable support bars 29 is provided immediately downstream of the station 5 and is connected via nonillustrated means to the actuator 48.

An intermediate workpiece 27 in the station 5 can be engaged by a gripper device 30 having a lower gripper arm 31 and an upper gripper arm 32. These arms 31 and 32 can be pivoted toward each other by means of an actuator connected to an operating rod 55 in an upright support 33 for the two arms 31 and 32 so that the lower arm 31 can be pivoted up toward the upper arm 32 which can simultaneously be pivoted down and vice versa for gripping and releasing an intermediate workpiece 27. The upright 33 is formed with a vertically extending slot 54 along which the upper arm 32 may be clamped for varying the vertical position of the upper arm 32. At its lower end the upright 33 is carried on a support 35 in turn riding via rollers 34 on a guide rail 36 for displacement in a direction 37 parallel to the transport directions 3 and 28. A lever 39 pivoted on the housing 1 and operated by the actuator 48 is connected via a link 38 to the upright 33 for reciprocation of the gripping device 30 between an upstream grabbing position seen in FIGS. 1-3 and a downstream releasing position seen in FIG. 4. Thus the outer ends 40 of the arms 31 and 32 can move to either side of the location 53 where welding of the tube formed by the foil 9 takes place as will be described below.

Figure 4:
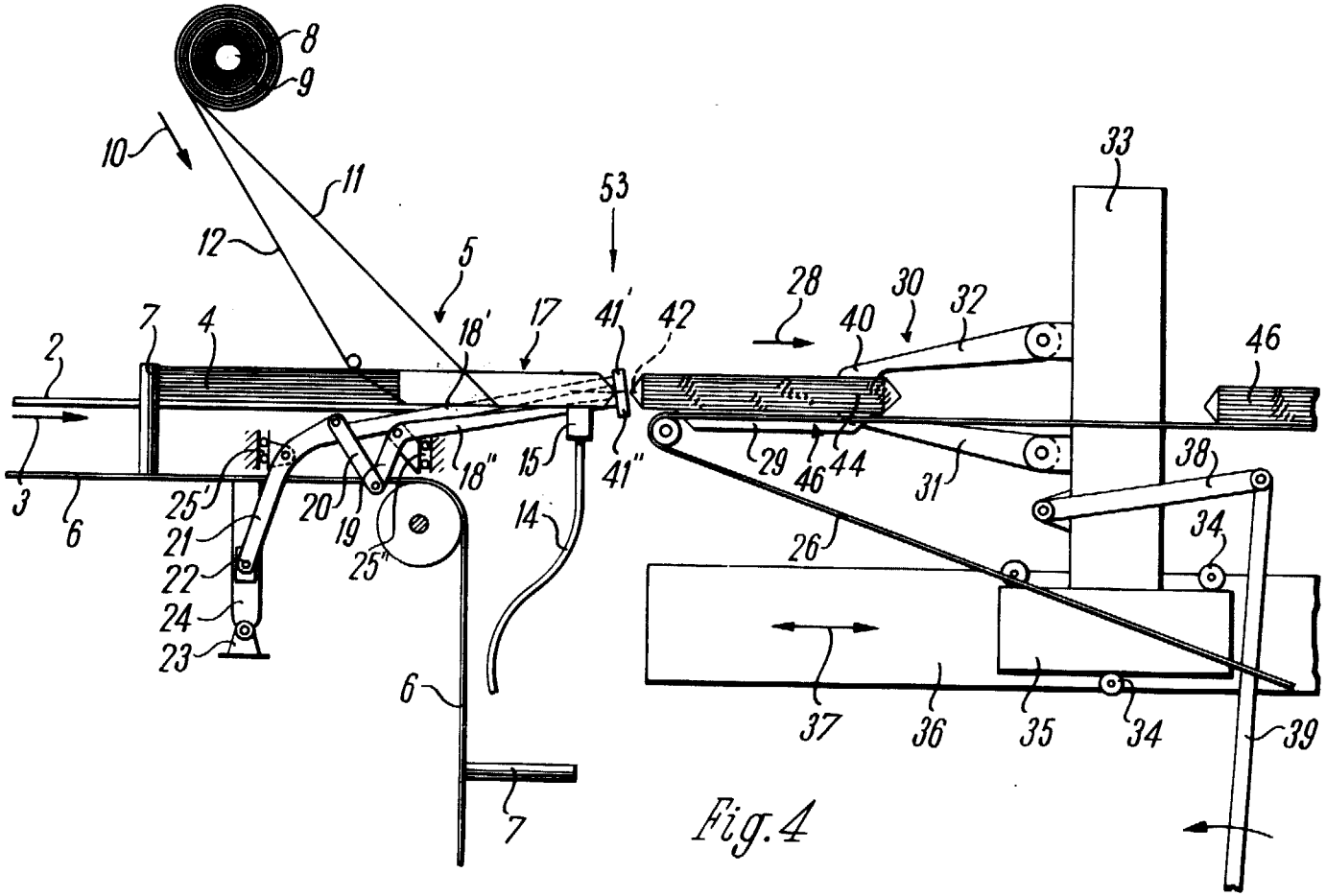
Figure 5:
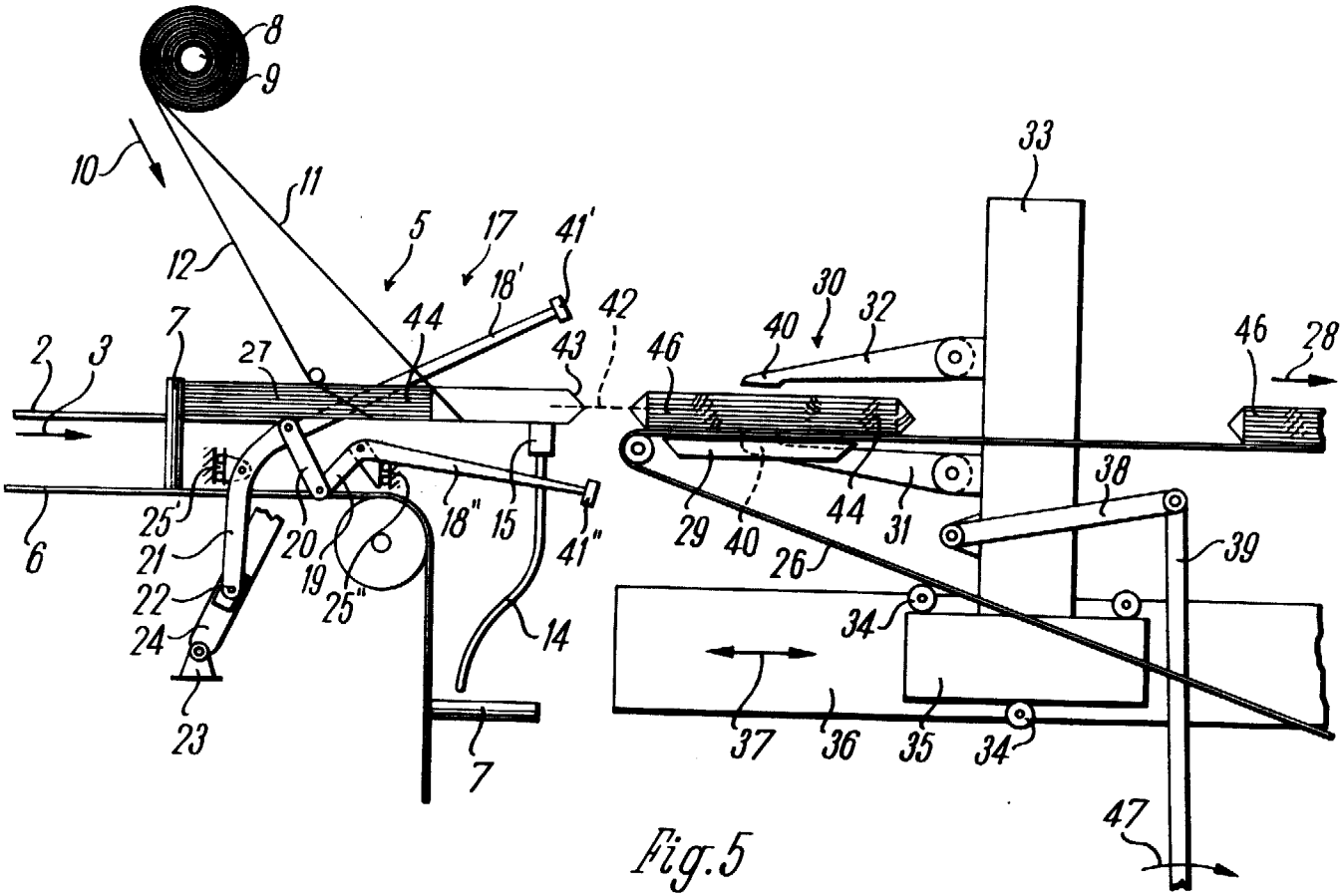

As shown in FIGS. 3-5 it is possible to displace the pivots 25' and 25" so that the plane 42 at which the two welding bars 41' and 41" would meet lies at a distance c above the plane P, this distance c being equal to half of the overall height s of the workpiece 4. In addition before using the machine the vertical spacing W between the gripping surfaces of the arms 31 and 32 is set, by varying the position of the upper arm 32, to be equal to slightly more than the height s.

The system described above functions as follows:

Assuming that the front end of the foil 9 has been formed into a closed tube, it is apparent that as the workpieces 4 are displaced into the station 5 they will be pushed into the tube directly up to the closed leading end 43 thereof. At that point (as shown in FIG. 3) the gripping device 30, which is already in the illustrated grabbing position, closes its arms 31 and 32 on the leading end 44 of the object 4 and is displaced backwardly by the actuator 48 by pivoting of the arm 39 in the direction 47 to the position of FIG. 4.

When in the position of FIG. 4 the bars 29, which have been raised above the plane P defined by the surfaces 2 in the upper reach of the belt 26, support the partially finished object whose leading end 44 is still gripped between the ends 40 of the arms 31 and 32. The lever 24 is therefore pivoted counterclockwise so that the two welding bars 41' and 41" are brought together to meet at the welding location 53 immediately upstream of the trailing end 42 of the gripped package. This will form a transverse heat seal at the rear end of a now completed package 46, will simultaneously form another heat seal 43 at the leading end of the tube formed by the foil 9, and will also simultaneously sever between these two heat seals to separate the package 46 completely from the foil 9.

Once these two seams have been formed and the package 46 has been cut from the foil 9 the arms 31 and 32 can separate slightly and the bars 29 can drop to deposit the finished package 46 on the belt 26 which will then transport it away in the direction 28. Subsequently the finished package 46 can be passed through a heating tunnel or the like for shrinking of the foil tightly in place.

In the position of FIG. 4 it is noted that the leading end of the tube formed by the foil 9 is snugly held between the bars 41' and 41" while the lower surface is held by the two suction devices 15. Thus the continuously advancing objects 4 are still pushed into the tube at the leading edge 43 thereof until they come to rest against the leading edge 43 and then automatically pull more of the foil 9 from the supply 8.

Thereafter as shown in FIG. 5 the arm 39 is moved against the direction 47 to displace the opened gripping device 30 back against the transport direction while simultaneously the two bars 41' and 41" of the welding device 17 open. By the time the ends 40 of the arms 31 and 32 are back upstream of the welding location 53 in the grabbing position, the next object 4 will have moved completely down to the closed end 43 so that the process can be repeated exactly as described above.

According to the invention, and in particular when the height s of the packages to be formed is relatively high, once in the downstream releasing position of FIG. 4 it is possible for the actuator 48 to move the gripping device 30 back upstream a short distance, normally equal to b/4 and equal at most to b/2; similarly the two suction holding devices 15 can be moved downstream slightly through the same small distance so that an amount of slack equal to b/2 will be produced between the trailing edge of the upstream package and the leading edge of the immediately following package at the location 53. This production of slack makes it considerably easier to seal together the opposite sides of the tube behind a relatively tall package.

The sensor 16 prevents the gripping device 31, 32 from closing and also prevents further operation of the downstream mechanism in case due to a failure in feed or input there is no object 4 in the station 5. In addition when no such presence is detected the longitudinal welding device 13 is dropped down to prevent it from melting a hole through the foil 9. The variation in package length within a relatively wide range is possible without reprogramming anything but the gripper movement of the machine. Furthermore no matter what the package length there will be absolutely no waste of the foil 9 since the gripping device 30 serves to position the trailing end of the package at the welding station no matter what its length.

It is noted that with the system according to the invention the amount of time taken to produce the weld can be set in accordance with the type of synthetic resin being welded, and is not determined mainly by the operation speed of the machine. Thus perfect welds can be produced at all times with virtually any of a wide range of synthetic-resin materials.

We claim:

1. A packaging method comprising the steps of:

(a) advancing a succession of objects one-by-one to a sealing station having a fixed sealing location in a forward transport direction with the leading end of each object spaced by a predetermined gap behind the trailing end of the preceding object;

(b) supplying a web to said station in said direction and wrapping said web around said objects as they each are advanced to said station;

(c) gripping said web against opposite sides of each object with grippers after wrapping of said object and thereafter displacing the grippers with the wrapped object and said web through a predetermined distance in said direction to substantially align the respective gap trailing it with said sealing location;

(c') thereafter displacing the grippers with the wrapped and gripped object with said web gripped against it back in a backward transport direction opposite to said forward transport direction through a small step equal to a small fraction of said predetermined distance to create slack in said web upstream of the wrapped and gripped object at said fixed sealing location;

(d) thereafter pinching and welding together said web in the slack region thereof at the gap aligned with said location and severing the wrapped and gripped object at the weld from said web;

(e) advancing the severed-off and wrapped object from said station; and (f) repeating steps (b) through (e) successively with each of the succeeding objects.

2. The method defined in claim 1 wherein said small step has a length equal to at most half the length of any of said gaps.

3. The method defined in claim 1 wherein said objects are fed continuously to said station.

4. A packaging apparatue comprising:

means for guiding a wrapping web generally in a transport direction to a wrapping station and forming said web at said station into a tube;

conveyor means for feeding a succession of objects spaced apart in said direction by respective gaps into said tube at said station;

a pair of welding tools at said station oppositely displaceable transversely of said direction and closely juxtaposable at a welding location fixed in said direction;

upper and lower grippers closable and openable transversely of said direction and displaceable jointly in said transport direction between a grabbing position upstream of said location and a releasing position downstream of said location;

means for closing said grippers when in said grabbing position on an object in said station in said tube and means for thereafter displacing said grippers with the gripped tube and object within said tube into said releasing position and opening said grippers whereby as the object in said web is gripped and displaced in said direction said web is pulled in said direction and to thereby substantially align a trailing gap between adjacent objects with said location, said displacing means also moving said grippers with the gripped tube and object within back in a direction opposite to said transport direction to create slack in said tube upstream of the wrapped and gripped object at said fixed sealing location; and means for closing said welding tools at said location on said web to weld same together when said gap is in said location and when said grippers are in said releasing position.

5. The apparatus defined in claim 4 wherein said conveyor means has a generally horizontal and planar support surface and said lower gripper lies generally flush with the plane of said surface.

6. The apparatus defined in claim 4 wherein said welding tools are substantially engageable together at said location at a generally horizontal meeting plane, said conveyor means including a generally horizontal and planar support surface defining a support plane under said horizontal meeting plane, said apparatus further comprising means carrying said welding tools for positioning said meeting plane in any of a multiplicity of vertically offset positions relative to said support plane.

7. The apparatus defined in claim 4, further comprising means for detecting the presence of any of said objects in said station and for preventing closing of said grippers when no such presence is detected.

8. The apparatus defined in claim 4, wherein said means for forming said web into a tube includes a longitudinal welding tool at said station.

9. The apparatus defined in claim 5 wherein one of said grippers is above the other gripper and is an upper gripper, said apparatus further comprising an upright and means for securing said upper gripper to said upright at any of a multiplicity of vertically offset positions relative to the other gripper.

* * * * *